US006828288B2

(12) United States Patent
Takeshima

(10) Patent No.: US 6,828,288 B2
(45) Date of Patent: Dec. 7, 2004

(54) CLEANING COMPOSITION AND METHOD OF PREPARING THE SAME

(75) Inventor: Kazuyuki Takeshima, Osaka (JP)

(73) Assignee: IQ Center Co., Ltd., Osaka (JP)

( * ) Notice: Subject to any disclaimer, the term of this patent is extended or adjusted under 35 U.S.C. 154(b) by 22 days.

(21) Appl. No.: 10/148,102

(22) PCT Filed: Nov. 29, 2000

(86) PCT No.: PCT/JP00/08410

§ 371 (c)(1),
(2), (4) Date: May 22, 2002

(87) PCT Pub. No.: WO01/40426

PCT Pub. Date: Jun. 7, 2001

(65) Prior Publication Data

US 2002/0193277 A1 Dec. 19, 2002

(30) Foreign Application Priority Data

Nov. 29, 1999 (JP) ..... 11-337112

(51) Int. Cl.[7] ..... C11D 17/00

(52) U.S. Cl. ..... 510/108; 510/389; 510/399; 510/481; 510/485; 510/507; 510/508; 510/511

(58) Field of Search ..... 510/389, 399, 510/481, 485, 507, 108, 508, 511, 267

(56) References Cited

U.S. PATENT DOCUMENTS

| | | | |
|---|---|---|---|
| 2,677,665 | A | 5/1954 | Oliver |
| 4,842,757 | A | 6/1989 | Reboa et al. |

FOREIGN PATENT DOCUMENTS

| | | | |
|---|---|---|---|
| CN | 1162632 | A | 10/1997 |
| CN | 1362632 | A | 10/1997 |
| EP | 0 336 652 | | 10/1989 |
| EP | 0 452 016 | | 10/1991 |
| GB | 160 892 | A | 4/1921 |
| JP | 51-93732 | | 8/1976 |
| JP | 57-202394 | | 12/1982 |
| JP | 02-003500 | | 1/1990 |
| JP | 09-87687 | | 3/1997 |
| JP | 2000-80782 | | 3/2000 |
| JP | 2001-31540 | | 2/2001 |

*Primary Examiner*—Necholus Ogden
(74) *Attorney, Agent, or Firm*—Knobbe, Martens Olson & Bear LLP

(57) ABSTRACT

The present invention provides a cleaning composition which has a superior cleaning power, bactericidal power and the like, and which is highly safe.

The present invention relates to a cleaning composition which is characterized in that this composition is formed by adding a soap to a mixture containing a silicic acid compound, an aluminum compound and water, or a solution of such a mixture.

14 Claims, No Drawings

CLEANING COMPOSITION AND METHOD OF PREPARING THE SAME

This application is the U.S. National Phase under 35 U.S.C. §371 of International Application PCT/JP00/08410, filed Nov. 29, 2000, which claims priority to Japanese Patent Application No. 11/337112, filed Nov. 29, 1999. The International Application was not published under PCT Article 21(2) in English.

TECHNICAL FIELD

The present invention relates to a cleaning composition and a method of preparing the same.

BACKGROUND ART

Soaps are superior in terms of biodegradability, and are said to be good for the environment. On the other hand, soaps suffer from the drawback of a weak cleaning power and antimicrobial power. As a result, synthetic cleaning agents (synthetic detergents) currently constitute the mainstream of cleaning agents.

Agents which contain higher alcohol type sulfuric acid esters, petroleum type alkylbenzenesulfonic acids, amino acid type alkylamino acids and the like as their chief components, and which also contain artificial chemical substances, polishing agents, moisture retaining agents and the like, are widely used as synthetic cleaning agents.

However, such synthetic cleaning agents are a problem in terms of environmental contamination. Synthetic cleaning agents seep into the ground and contaminate the ground water, soil and the like, so that such agents have a deleterious effect on the environment and on human beings. For example, octylphenol, which is widely used as a raw material in synthetic cleaning agents, is an artificial chemical substance that is considered to be an environmental hormone or endocrine-disrupting chemical; this substance remains intact without undergoing degradation. In fact, octylphenol has been detected in many seas, rivers, lakes and the like.

Furthermore, water pollution, red tides and the like are created by the flow of common waste water containing these synthetic cleaning agents into the ocean. Such problems are especially serious in areas that lack sewage treatment facilities.

Moreover, synthetic cleaning agents are finely classified according to use, such as kitchen use, general household use, toilet use, laundry use, lavatory use, automotive use and the like; as a result, not only is such specialized use bothersome for the consumer, but used containers are generated in large quantities.

There are also problems regarding synthetic cleaning agents that are used in various applications. For example, cleaning agents used for general cleaning contain trichloroethylene; however, there is a danger that this may be a carcinogenic substance. Cleaning agents used on the hair (shampoos), as well as cleaning agents used on the body and the like, are weakly acidic; synthetic surfactants or the like must be added to these agents, and such surfactants are a cause of water pollution. In the case of cleaning agents used on bathtubs (anti-mold agents and the like), care must be taken so that the agents do not contact the body.

Thus, although synthetic cleaning agents are superior in terms of cleaning power and the like, such agents are a source of environmental problems such as water pollution and the like. As a result, cleaning agents that have the cleaning power and anti-microbial power of synthetic cleaning agents with the safety of soaps is urgently required. However, such cleaning agents have not yet been developed or adapted for practical use.

DISCLOSURE OF THE INVENTION

It is a principal object of the present invention to provide a cleaning composition which combines a superior cleaning power, anti-microbial power and the like with a high degree of safety.

With the foregoing problems of the prior art in view, the present inventor conducted diligent research; as a result of this research, the inventor discovered that a specified composition makes it possible to achieve the above-mentioned object. This discovery led to the perfection of the present invention.

Specifically, the present invention relates to the cleaning composition described below, and a method of manufacturing the same.

1. A cleaning composition which is characterized in that this composition is obtained by adding a soap to a mixture containing a silicic acid compound, an aluminum compound and water, or a solution of the same.

2. The cleaning composition described in 1 above, wherein the silicic acid compound consists of at least one compound selected from a set consisting of silicates and silicic acid.

3. The cleaning composition described in 1 above, wherein the aluminum compound consists of at least one compound selected from the group consisting of aluminum oxide and aluminum hydroxide.

4. The cleaning composition described in any of 1 through 3 above, wherein clay is used as all or part of the silicic acid compound.

5. A method of preparing a cleaning composition comprising the steps of preparing a mixture containing a silicic acid compound, an aluminum compound and water, and then adding a soap to the mixture or a solution of the same.

6. The method described in 5 above, wherein clay is used as all or part of the silicic acid compound.

7. The method described in 5 above, wherein the preparation of the mixture is performed at a temperature of 80° C. or greater.

8. A cleaning composition which is characterized in that that this composition is formed by adding a soap to a mixture containing kaolin, sodium silicate, aluminum hydroxide and water, or a solution of the same.

9. The cleaning composition described in 8 above, wherein the mixture further contains at least one compound selected from a set consisting of sodium meta-silicate and sodium carbonate.

10. The cleaning composition described in 8 above, wherein the mixture contains 50 to 200 parts by weight of sodium silicate, 50 to 200 parts by weight of aluminum hydroxide and 300 to 3000 parts by weight of water per 100 parts by weight of kaolin.

11. A method of preparing a cleaning composition which is characterized in that a mixture containing kaolin, sodium silicate, aluminum hydroxide and water is prepared, after which a soap is added to the mixture or a solution of the same.

12. The method described in 11 above, in which the mixture further contains at least one compound selected from the group consisting of sodium meta-silicate and sodium carbonate.

13. The method described in 11 above, in which the mixing of the mixture is performed at a temperature of 80° C. or greater.

(1) Cleaning Composition

The cleaning composition of the present invention is characterized in that this composition is formed by adding a soap to a mixture containing a silicic acid compound, an aluminum compound and water, or a solution of the same.

There are no particular restrictions on the silicic acid compound used, as long as this compound is an inorganic silicic acid compound. Usually one or more compounds selected from the group consisting of silicates and silicic acid (and especially silicates) can be used. Examples of silicates that can be used include silicates of alkali metals such as sodium silicate (sodium ortho-silicate, sodium meta-silicate and the like), potassium silicate and the like, silicates of alkaline earth metals such as calcium silicate, magnesium silicate and the like, and other silicates such as aluminum silicate and the like. Known compounds or commercially marketed compounds may be used as these silicic acid compounds.

In the present invention, clay may be used as all or part of the silicic acid compound. There are no particular restrictions on the clay used, as long as this clay contains a silicic acid compound as a clay mineral. For example, a clay containing kaolinite (i.e., kaolin) may be used. In the present invention, it is desirable to use kaolin and sodium silicate (water glass) as silicic acid compounds.

There are no restrictions on the aluminum compound used; usually one or more compounds selected from the group consisting of aluminum oxide and aluminum hydroxide may be used. Furthermore, salts such as aluminum sulfate or the like may also be used. Known compounds or commercially marketed compounds may be used as these aluminum compounds.

The amount of aluminum compound used may be suitably determined according to the type of aluminum compound that is used. Usually this amount may range from about 50 to 200 parts by weight, preferably from 60 to 100 parts by weight, per 100 parts by weight of the silicic acid compound used.

In the composition of the present invention, carbonates may also be added as required. Usually one or more compounds selected from the group consisting of carbonates of alkali metals and carbonates of alkaline earth metals may be appropriately used. Examples of carbonates that can be used include sodium carbonate, potassium carbonate, magnesium carbonate, calcium carbonate and the like. Known compounds or commercially marketed compounds may be used as these compounds.

In cases where carbonates are used, the amount used may be appropriately determined in accordance with the types of carbonates used and similar factors. Generally, the amount may range from approximately 10 to 50 parts by weight, preferably from 20 to 40 parts by weight, based on 100 parts by weight of the silicic acid compound used.

The amount of water may be appropriately altered in accordance with the types of components used, the amounts of the respective components that are added, the application or intended use of the final product and the like. Usually, the amount of water may range from approximately 300 to 3000 parts by weight, preferably from 400 to 2000 parts by weight, per 100 parts by weight of the silicic acid compound used.

In the composition of the present invention, a mixture of the abovementioned components or an aqueous solution of such a mixture is mixed with a soap. In regard to the solution of the present invention, the supernatant liquid that is obtained after the mixture has been allowed to stand for an appropriate period of time can be used (as a solution). Alternatively, the liquid phase that is obtained after the mixture has been treated by filtration, centrifugal separation or the like (i. e., the "filtrate" in the case of filtration) can also be used as the abovementioned solution. Furthermore, the mixture can be used "as is", or the solid content obtained after the mixture has been treated by settling, filtration, centrifugal separation or the like (i.e., a cake-form substance containing moisture) can also be used as the mixture of the present invention.

The soap may consist of higher fatty acid salts (i.e., may be a fatty acid soap). For example, known soaps such as sodium soaps, potassium soaps, amine soaps, metal soaps or the like may be used. Soaps reclaimed from waste edible oils or the like may also be used. There are no restrictions on the physical form of these soaps; liquid-form, powder-form or granular soaps may be used. Furthermore, commercially marketed products may be used as these soaps.

The amount of soap added may be appropriately set in accordance with the type of soap used and the application of the final product, and according to whether the soap is added to the mixture or an aqueous solution of the mixture. In the present invention, sodium soaps, potassium soaps and the like are especially desirable. When such a soap is added to the mixture, the amount of soap may range from about 40 to 250 parts by weight based on 100 parts by weight of the mixture (solid content). When this soap is mixed with the abovementioned solution, the amount of soap may range from about 10 to 70 parts by weight, preferably from 10 to 40 parts by weight per 100 parts by weight of the solution.

In the composition of the present invention, in addition to the abovementioned components, moisture-retaining agents such as glycerin, squalene, jojoba oil, hyaluronic acid or the like, thickeners such as hydroxyethylcellulose, alginic acid, sodium lactate or the like, and additives such as natural fragrances or the like, may be added to the mixture or solution of the same.

The composition of the present invention may have various physical forms depending on whether the abovementioned mixture or solution is used. For example, the composition may have the form of a liquid, cream, paste, wax, powder or the like. The composition of the present invention may be appropriately used in various types of cleaning compositions including antimicrobial agents, anti-mold agents, anti-rust agents or the like.

In the composition of the present invention, kaolin is preferably used as part of the silicic acid compound. Specifically, a cleaning composition which is characterized in that this composition is formed by mixing a mixture that contains kaolin, sodium silicate, aluminum hydroxide and water, or a solution derived from the same, with a soap is desirable for use. Furthermore, the mixture may also contain one or more compounds selected from the group consisting of sodium meta-silicate and sodium carbonate. Components similar to those described above may be used as these respective components.

In regard to the composition ratios that are used in cases where kaolin is used in the composition of the present invention, it is desirable to set the respective contents in the mixture at 50 to 200 parts by weight of sodium silicate, 50 to 200 parts by weight of aluminum hydroxide and 300 to 3000 parts by weight of water per 100 parts by weight of kaolin. Furthermore, in cases where sodium meta-silicate and sodium carbonate are used, it is desirable to set the respective contents in the abovementioned mixture at 50 to 200 parts by weight of sodium silicate, 50 to 200 parts by weight of aluminum hydroxide, 10 to 50 parts by weight of sodium meta-silicate, 10 to 50 parts by weight of sodium carbonate and 300 to 3000 parts by weight of water per 100 parts by weight of kaolin.

(2) Method of Preparation of Cleaning Composition

As long as the abovementioned components can be uniformly mixed, there are no particular restrictions on the method of preparing the composition of the present invention. For example, a soap may be added following the preparation of the abovementioned mixture, or the respective components may be mixed with a soap in an appropriate order. In the present invention, it is especially desirable to prepare a mixture containing a silicic acid compound, an aluminum compound and water, and then to add a soap to the mixture or an aqueous solution of the mixture.

In regard to the silicic acid compound, aluminum compound, water and soap, and the amounts of these substances that are mixed in the composition, the components and mixture amounts indicated above may be respectively used. Furthermore, as was described above, clay may be used as all or part of the silicic acid compound. Substances that are the same as those described above may be used as this clay. If necessary, furthermore, carbonates may be added. It is desirable that components other than the soap (including additives) be added at the time of preparation of the mixture.

In the present invention, a mixture containing a silicic acid compound, an aluminum compound and water is first prepared. Mixing can be accomplished using a known device such as a mixer, kneader or the like. Furthermore, it is desirable that this mixing be performed while heat is applied. It is desirable that this heating be performed at a temperature of 80° C. or greater (boiling is especially desirable).

Besides using the mixture "as is", it is also possible to use the solid content (cake-form substance containing moisture) obtained by a treatment such as precipitation, filtration, centrifugal separation or the like as the mixture of the present invention. In regard to the solution, the supernatant obtained after the mixture has been allowed to stand for an appropriate period of time may be used (as a solution), or the liquid phase that is obtained after the mixture has been treated by filtration, centrifugal separation or the like (i.e., the "filtrate" in the case of filtration) may also be used as this solution.

A soap is mixed with the mixture or solution of the same thus obtained. In cases where the mixing is performed under heating, it is desirable that the soap be added to the mixture or solution of the same after the mixture has been cooled to the vicinity of room temperature. Furthermore, when the soap is added, the water content of the mixture can be appropriately adjusted in accordance with the type of soap, desired composition properties and the like. The addition of this soap can be accomplished using a mixer, kneader or the like. The soap may be added in powdered form, solution form or the like.

In cases where the kaolin is used, the cleaning composition can be appropriately obtained by (for example) a cleaning composition manufacturing method which is characterized in that a mixture containing a mixture containing kaolin, sodium silicate, aluminum hydroxide and water is prepared, after which a soap is mixed with the mixture or solution of the same. The mixture may also contain at least one compound selected from the group consisting of sodium meta-silicate and sodium carbonate.

The mixing is usually performed under heating at a temperature of 80° C. or greater, and is preferably performed under boiling conditions. The remaining conditions may be set in accordance with the preparing method.

The cleaning composition of the present invention can be obtained in this way. In the present invention, cleaning agents, microbicidal agents, antimicrobial agents, anti-mold agents, anti-rust agents and the like having various properties and characteristics may be prepared as desired.

The present invention makes it possible to provide a cleaning composition that combines a superior cleaning power, antimicrobial power etc. with a high degree of safety. Since the composition of the present invention consists chiefly of inorganic compounds such as silicic acid compounds and the like, this composition has a high degree of safety (that is to say, the composition is superior in terms of biodegradability), and is gentle on the environment, unlike synthetic cleaning agents. Furthermore, the cleaning composition of the present invention exhibits a cleaning power that is comparable to or greater than that of synthetic cleaning agents.

Furthermore, since the composition of the present invention possesses a microbicidal power, antimicrobial characteristics, anti-mold characteristics, anti-rust characteristics and the like, this composition can be used in a broader range of applications than soaps that do not have such characteristics. Specifically, the composition of the present invention is also useful in microbicidal agents, antimicrobial agents, anti-mold agents, anti-rust agents and the like.

BEST MODE FOR CARRYING OUT THE INVENTION

Below, the special features of the present invention will be described in much more definite terms by indicating examples and comparative examples. However, the present invention is not limited to these examples.

EXAMPLE OF MANUFACTURE 1

200 parts by weight of kaolin, 200 parts by weight of sodium silicate (water glass), 350 parts by weight of the aluminum hydroxide, 50 parts by weight of sodium carbonate, 50 parts by weight of sodium meta-silicate and 4200 parts by weight of water were mixed, and these ingredients were boiled for about 30 minutes while being agitated, and then a mixture was obtained by cooling this system to room temperature.

Example 1

The mixture obtained in Example of Manufacture 1 was further filtered, and the residue (cake-form substance (in a state containing moisture)) was used as a mixture. A soap was added to the cake-form substance, and a crime-form cleaning composition was obtained by thorough mixing using a mixer. The amount of soap was set at approximately 37 parts by weight per 100 parts by weight of the solid content of the abovementioned cake-form substance. Furthermore, "OK-2" (commercial name of a product manufactured by Nippon Yushi) was used as the soap. Furthermore, a wax-form cleaning composition was successfully obtained from the composition by further reducing the water content.

Example 2

The mixture obtained in Example of Manufacture 1 was filtered, and the filtrate thus obtained was used as a solution. A 1 wt % aqueous solution of hydroxyethylcellulose was added to this solution at the rate of 1 wt %. Then, a soap was added, and these ingredients were mixed so that no bubbles were formed, thus producing a liquid-form cleaning composition. The amount of soap added in this case was approximately 40 parts by weight per 100 parts by weight of the filtrate. Furthermore, a mixture of "OK-2" and "LK-30" (commercial names of products manufactured by Nippon Yushi) mixed at a weight ratio of 1:1 was used as the soap.

Example 3

40 g of a soap was added to 100 ml of the solution obtained in Example 2; afterward, 1 ml of a 1 wt % aqueous solution of alginic acid and 1 ml of a 1 wt % aqueous solution of an inorganic macromolecular smectite was added, thus producing a liquid-form cleaning composition. Furthermore, a mixture prepared by mixing 10 g of "LK-30" and 20 g of "OK-2" (both commercial names of products manufactured by Nippon Yushi) was used as the soap.

Example 4

30 g of a 50 wt % aqueous solution of soap was added to 100 ml of the solution obtained in Example 2; afterward, 2 ml of a 1 wt % aqueous solution of carboxymethylcellulose, 1 ml of a 1 wt % aqueous solution of an inorganic macromolecular smectite, 2 ml of vinegar and 1 ml of a 2 wt % aqueous solution of sodium lactate were added, thus producing a liquid-form cleaning composition. Furthermore, a mixture prepared by mixing 20 g of "LK-30" and 20 g of "OK-2" (both commercial names of products manufactured by Nippon Yushi) was used as the abovementioned soap.

Example 5

1800 g of a soap was mixed with 850 g of the cake-form substance obtained in Example 1, thus producing a cleaning composition. Furthermore, this composition was placed in a kneader and granulated so that granules were obtained. Then, a powder-form cleaning agent was obtained by pulverizing these granules. Furthermore, a mixture formed by mixing equal amounts of "OK-2", "ON-8", "ON-1N", "LN-1" and "MK-1" (all commercial names of products manufactured by Nippon Yushi) was used as the abovementioned soap.

Example 6

1550 g of a soap containing 50 g or more of a soap reclaimed from waste edible oils (including substances obtained by purifying edible oils or processing edible oils into fatty acids) was mixed with 850 g of the cake-form substance obtained in Example 1, thus producing a granular product. This granular product was placed in a kneader and granulated, and the granulated preparation thus obtained was pulverized to produce a powder-form cleaning composition.

Test Example 1

The biodegradability of the cleaning compositions obtained in Example 1 and Example 2 was investigated. 200 mg of the composition of the present invention, 500 ml of an inorganic culturing salt medium and 30 ml of the supernatant liquid of standard active sludge (Kagaku Busshitsu Hyoka Kenkyu Kiko Ltd.) (weight when dry: 30 mg) were placed in a jar fermenter, and a degradation test was performed at 200 rpm·30° C. Elimination of gases was accomplished by supplying air (at the rate of 20 ml/min) that had been passed through a carbon dioxide gas absorber containing an NaOH solution. The discharged air was conducted into an NaOH carbon dioxide gas trap (consisting of three connected units), and the amount of inorganic carbon was measured periodically using the IC mode of a TOC measuring device (IC value: $CO_2$ concentration). In this case, the culture in the fermenter was also sampled and filtered, and the amount of organic carbon was then measured (TOC). The abovementioned IC value is an index which indicates the degree to which the sample was converted into inorganic matter (i.e., converted into carbon dioxide gas). Furthermore, the abovementioned TOC value is an index which indicates the residual amount of sample in the water. The results obtained for the composition of Example 1 are shown in Table 1. The results obtained for the composition of Example 2 are shown in Table 2.

TABLE 1

| | | <IC Value ($CO_2$)> | | |
|---|---|---|---|---|
| Sample | Number of Days | Active Sludge Blank (ppm) | Sample + Active Sludge (ppm) | Net Value (ppm) |
| Example 1 | 7 days | 21.0 | 58.2 | 37.2 |
| Example 1 | 14 days | 22.6 | 24.0 | 1.4 |
| | | <TOC Value> | | |
| Sample | Number of Days | Sample + Active Sludge (ppm)* | Sample Only (ppm) | |
| Example 1 | 7 days | 13.0 | 20.7 | |
| Example 1 | 14 days | 5.3 | 19.3 | |

*indicates the net value (value obtained by subtracting the value of the active sludge blank).

The net value of the IC value (i.e., the value obtained by subtracting the IC value of the active sludge blank from the IC value of the sample consisting of the composition of the present invention+active sludge) reached a maximum of 37.2 ppm on the seventh day. It was confirmed from this that biodegradation is more or less completed in seven days, so that the composition of the present invention is converted into carbon dioxide gas. Furthermore, it is seen from the fact that the TOC value decreases with the passage of time that the composition of the present invention dissolved in water is subjected to biodegradation, so that the composition is eliminated from this water.

TABLE 2

| | | <IC Value ($CO_2$)> | | |
|---|---|---|---|---|
| Sample | Number of Days | Active Sludge Blank (ppm) | Sample + Active Sludge (ppm) | Net Value (ppm) |
| Example 2 | 6 days | 13.6 | 36.5 | 22.9 |
| Example 2 | 10 days | 13.0 | 13.9 | 0.9 |
| Example 2 | 15 days | 15.3 | 15.8 | 0.5 |
| | | <TOC Value> | | |
| Sample | Number of Days | Sample + Active Sludge (ppm)* | | |
| Example 2 | 10 days | 7.8 | | |
| Example 2 | 15 days | 0.3 | | |
| Example 2 | 22 days | 0.2 | | |

*indicates the net value (value obtained by subtracting the value of the active sludge blank).

According to Table 2, the net value of the IC value reached a maximum of 22.9 ppm on the sixth day. It was confirmed from this that biodegradation is more or less completed in six days. Furthermore, it is seen from the fact that the TOC value decreases with the passage of time that the composition of the present invention possesses biodegradability.

Test Example 2

The microbicidal and anti-mold properties of the liquid-form cleaning composition obtained in Example 2 were investigated.

(Test of Microbicidal and Anti-Mold Properties)

The test method used was as follows: in the case of fungi, the organisms were cultured in a flat plate culture for 5 days at 28° C. using a potato dextrose agar culture medium (PDA) (manufactured by Eiken Kagaku), and in the case of bacteria, the organisms were cultured in a flat plate culture for 20 hours at 37° C. using a standard agar culture medium. Testing was performed using two methods, i.e., a method in which 0.5 ml of a liquid preparation of the test organisms was mixed with the culture medium, and a method in which the culture medium was coated with 0.5 ml of a liquid preparation of the test organisms. 0.2 ml of the composition of the present invention was added dropwise from a paper disk and a penicillin cup; the presence or absence of the formation of a halo (transparent zone free of organisms) in mixing and coating was observed, and the samples treated by both methods were evaluated collectively. The results obtained are shown in Table 3. In regard to the test results shown in Table 3, in cases where halo formation was seen, samples in which the size of the halo was 11 mm or greater were graded as "large", samples in which the size of the halo was 6 to 10 mm were graded as "medium", and samples in which the size of the halo was 1 to 5 mm were graded as "small". Samples which showed no halo formation were graded as "none".

For purposes of comparison, the results of similar tests performed for Maruseru Sekken (a commercially marketed soap) and sodium dodecylbenzenesulfonate are also shown in Table 3.

TABLE 3

| Type of Organism | Example 2 | Maruseru Sekken | DBS* |
|---|---|---|---|
| Penicillium | large | none | large |
| *Aspergillus niger* | large | none | large |
| *Staphylococcus aureus* | large | small | large |
| *Escherichia coli* | large | medium | large |

*indicates sodium dodecylbenzenesulfonate (Measurement of Numbers of Live Organisms)

The measurement method was curried out according to Microorganism Test Methods—Chukai(1990), Microorganism Test Methods, (3) Number of Live Organisms, 1) Mixed Flat Plate Culturing Method (page 148). In concrete terms, 1 g of the composition of the present invention was suspended in 9 ml of sterilized water. A shaken culture was then performed for 6 hours at 37° C. using a nutrient broth culture solution. *Staphylococcus aureus* (ATCC 25923) and *Escherichia coli* (IFO 3301) were diluted 100 times with physiological saline, and the abovementioned suspension was inoculated with 0.1 ml of the diluted liquid preparation. The numbers of live organisms were measured at 1 minute and 10 minutes following inoculation. The results obtained are shown in Table 4.

TABLE 4

| | Number of *Staphylococcus aureus* organisms (× 1000/ml) | | Number of *Escherichia coli* organisms (× 1000/ml) | |
|---|---|---|---|---|
| Sample | 1 min | 10 min | 1 min | 10 min |
| Saline | 6.4 | 4.4 | 5.3 | 5.2 |
| Example 2 | 0.3 | 0.1 | 0.0 | 0.0 |

Test Example 3

The cleaning power of the liquid-form cleaning composition of Example 2 was investigated. In regard to the test method, testing was performed in accordance with the standards of JIS-K-3370 using a solution (1.5 g/liter) of the abovementioned composition. As a result, it was confirmed that the composition of the present invention has a cleaning power comparable to or greater than that of the standard detergent designated in the abovementioned industrial standard.

Test Example 4

The components and cleaning power of the liquid-form cleaning composition of Example 6 were investigated. In the analysis of the components, the items described in JIS-K-3303 were analyzed according to the method described in JIS-K-3304. The results obtained are shown in Table 5. In Table 5, the numerical value shown in parentheses is the pH value of the water used for dilution. The percentages of the items other than the water content are values for the dry sample.

TABLE 5

| Item | Analysis Value |
|---|---|
| Water content | 0.9% |
| pH (40 g/30 L, 25° C.) | 10.23 (7.68) |
| Pure soap content (as Na salt) | 54.7% |
| Petroleum ether soluble content | 0.3% |
| Ethanol—insoluble content | 44.6% |

Furthermore, in regard to the evaluation of the cleaning power, a commercially marketed soiled fabric (5 cm×5 cm) manufactured by the Sentaku Kagaku Kyokai [Laundry Science Association] was laundered using a Terg-O-Tometer type cleaning power testing machine, and the results were compared with those obtained using a JIS standard soap. Cleaning was performed as follows: 1 liter of the test aqueous solution at a standard use concentration was placed in each cleaning tank, five sheets of the soiled fabric and five sheets of a white fabric (10 cm×10 cm) were placed in this solution, cleaning under agitation (120 rpm) was performed for 10 minutes, and rinsing was then performed twice for 3 minutes each time. After the respective fabric samples were dried, the samples were ironed, and the cleaning power was then evaluated by measuring the reflectivity of the fabric samples using a color-measuring color difference meter. The water used was artificial hard water with a total hardness of 50 ppm (Ca:Mg=3:2), and the cleaning temperature was set at 30° C. As a result, it was confirmed that the cleaning power of the present invention (standard use concentration: approximately 40 g/30 liters) showed results comparable to or superior to the cleaning power of the standard soap designated in JIS-K-3303.

What is claimed is:

1. A cleaning composition comprising:

a supernatant of a mixture containing a silicic acid compound, aluminum hydroxide, and water, said mixture being a uniform mixture that can be obtained by mixing a silicic acid, aluminum hydroxide, and water at a temperature ranging from 80° C. to a boiling temperature, wherein said silicic acid compound comprises clay which constitutes all or part of said silicic acid compound;

(b) a soap, said soap and element (a) being uniformly mixed; and (c) no synthetic cleaning agents.

2. A method of preparing a cleaning composition comprising the steps of:

preparing a mixture by mixing a silicic acid compound, aluminum hydroxide, and water at a temperature ranging from 80° C. to a boiling temperature wherein said silicic acid compound comprises clay which constitutes all or part of said silicic acid compound;

obtaining supernatant of the mixture, as element (a); and uniformly mixing a soap and element (a) to obtain a cleaning composition.

3. The cleaning composition according to claim 1, wherein said silicic acid compound is at least one compound selected from silicates and silicic acid.

4. The cleaning composition according to claim 1, wherein said clay is kaolinite.

5. The cleaning composition according to claim 1, where the amount of said aluminum hydroxide is about 50 to 200 parts by weight per 100 parts by weight of said silicic acid compound.

6. The cleaning composition according to claim 1, wherein the amount of said aluminum hydroxide is 60 to 100 parts by weight per 100 parts by weight of said silicic acid compound.

7. The cleaning composition according to claim 1, wherein the amount of said soap is about 10 to 70 parts by weight per 100 parts by weight of said supernatant.

8. The cleaning composition according to claim 1, wherein the amount of said soap is 10 to 40 parts by weight per 100 parts by weight of said supernatant.

9. The method according to claim 2, wherein said silicic acid compound is at least one compound selected from silicates and silicic acid.

10. The method according to claim 2, wherein said clay is kaolinite.

11. The method according to claim 2, wherein the amount of said aluminum hydroxide is about 50 to 200 parts by weight per 100 parts by weight of said silicic acid compound.

12. The method according to claim 2, wherein the amount of said aluminum hydroxide is 60 to 100 parts by weight per 100 parts by weight of said silicic acid compound.

13. The method according to claim 2, wherein the amount of said soap is about 10 to 70 parts by weight per 100 parts by weight of said supernatant.

14. The method according to claim 2, wherein the amount of said soap is 10 to 40 parts by weight per 100 parts by weight of said supernatant.

* * * * *